US007681314B2

(12) United States Patent
Follo

(10) Patent No.: US 7,681,314 B2
(45) Date of Patent: Mar. 23, 2010

(54) INTER-BLADE GUARD AND METHOD FOR MANUFACTURING SAME

(75) Inventor: Thomas A. Follo, Milford, CT (US)

(73) Assignee: Eveready Battery Company Inc., St. Louis, MO (US)

( * ) Notice: Subject to any disclaimer, the term of this patent is extended or adjusted under 35 U.S.C. 154(b) by 0 days.

(21) Appl. No.: 11/150,744

(22) Filed: Jun. 10, 2005

(65) Prior Publication Data

US 2006/0277759 A1 Dec. 14, 2006

(51) Int. Cl.
*B26B 19/00* (2006.01)

(52) U.S. Cl. ..... 30/34.2; 30/41.5; 30/50; 30/78

(58) Field of Classification Search ..... 30/41, 30/50, 41.5, 34.2, 77, 78
See application file for complete search history.

(56) References Cited

U.S. PATENT DOCUMENTS

| | | | | | |
|---|---|---|---|---|---|
| 1,920,711 | A * | 8/1933 | Pelizzola | 30/50 |
| 4,272,885 | A * | 6/1981 | Ferraro | 30/47 |
| 4,354,312 | A * | 10/1982 | Trotta | 30/47 |
| 4,403,413 | A * | 9/1983 | Trotta | 30/47 |
| 5,090,124 | A * | 2/1992 | Althaus | 30/50 |
| 5,359,774 | A * | 11/1994 | Althaus | 30/50 |
| 5,546,660 | A * | 8/1996 | Burout et al. | 30/50 |
| 5,551,155 | A * | 9/1996 | Prochaska | 30/50 |
| 5,590,468 | A * | 1/1997 | Prochaska | 30/41 |
| 5,666,729 | A * | 9/1997 | Ferraro | 30/50 |
| 5,822,862 | A * | 10/1998 | Ferraro | 30/50 |
| 6,167,625 | B1 * | 1/2001 | King et al. | 30/34.2 |
| 6,243,951 | B1 * | 6/2001 | Oldroyd | 30/34.2 |
| 6,305,084 | B1 * | 10/2001 | Zucker | 30/50 |
| 6,378,211 | B1 * | 4/2002 | McCool et al. | 30/50 |
| 6,397,473 | B1 * | 6/2002 | Clark | 30/50 |
| 6,550,141 | B1 * | 4/2003 | Rivers et al. | 30/50 |
| 6,568,084 | B2 * | 5/2003 | McCool et al. | 30/50 |
| 6,655,029 | B2 * | 12/2003 | Saito | 30/50 |
| 6,769,180 | B2 * | 8/2004 | Coffin | 30/50 |
| 7,111,401 | B2 * | 9/2006 | Richard | 30/50 |
| 2004/0231161 | A1 * | 11/2004 | Coffin et al. | 30/50 |
| 2004/0255467 | A1 * | 12/2004 | Lembke et al. | 30/50 |

FOREIGN PATENT DOCUMENTS

| | | |
|---|---|---|
| EP | 667813 B1 | 4/1998 |
| EP | 783397 B1 | 11/2001 |
| WO | WO 96/04111 A | 2/1996 |

OTHER PUBLICATIONS

International Search Report from PCT/US2006/022262, dated Oct. 31, 2006.

* cited by examiner

*Primary Examiner*—Maurina Rachuba
(74) *Attorney, Agent, or Firm*—Energizer Personal CareLLC

(57) ABSTRACT

According to the present invention, a razor cartridge includes a plurality of skin-engaging elements disposed on a frame. The skin engaging elements include at least two or more substantially blades having a sharpened cutting edge, a first inter-blade guard, and a cap. The two or more blades are disposed on the frame in parallel relation to one another. The first inter-blade guard is disposed on the frame between two (2) blades. A rinse-through gap extends across substantially the entire length of the frame between the first inter-blade guard and the blade aft the first inter-blade guard.

17 Claims, 5 Drawing Sheets

INTER-BLADE GUARD AND METHOD FOR MANUFACTURING SAME

BACKGROUND OF THE INVENTION

1. Field of the Invention

The present invention relates to razor cartridges in general and, more particularly, to razor cartridges having an inter-blade guard disposed between two blades.

2. Description of the Prior Art

Modern wet shaving razors include a plurality of blades disposed within a razor cartridge that is mounted on a handle. Some safety razors have a disposable razor cartridge that is removably mounted on a reusable handle while others have a handle and a razor cartridge that are manufactured as a single, disposable unit. Typically, razor cartridges include a frame with several skin-engaging elements, such as a guard, two or more blades, and a cap, mounted thereon. The guard is disposed forward of the blades and a cap is disposed aft of the blades. The terms "forward" and "aft", as used herein, define the relative position between features of the razor cartridge. A skin-engaging feature "forward" of, for example, the blades is positioned such that the surface to be shaved encounters that feature prior to encountering the blades during normal shaving operation. Conversely, a skin-engaging feature "aft" of, for example, the blades is positioned such that the surface to be shaved encounters that feature after encountering the blades during normal shaving.

Typically, two or more blades are positioned in the razor cartridge between the guard and the cap such that they are in parallel relation to, and slightly separated from one another. Each blade includes a sharpened cutting edge that is operable to shave hair from a desired surface. The distance between the blades (i.e., the "tip-to-tip span") is measured widthwise across the razor cartridge along a straight line between the sharpened cutting edges of neighboring blades. During shaving, the user draws the razor cartridge across the surface to be shaved and the cutting edges of the razor blades shave the hair from the desired surface.

The performance and commercial success of a razor cartridge is a balance of many factors and characteristics, including, but not limited to, safety, comfort and rinsability. The tip-to-tip span of the blades disposed on the frame has a major impact on each of the above-mentioned factors. On one hand, recent studies have shown that reducing the tip-to-tip span increases shaving comfort. A razor cartridge with reduced tip-to-tip spans allows for a smaller skin bulge to enter into the gap between adjacent blades during normal shaving. FIG. 1 illustrates the difference in the skin bulge that is created by razor blades with varying tip-to-tip spans. As shown in FIG. 1, the skin bulge between the two blades with the relatively smaller tip-to-tip span approaches the trailing blade at a shallower angle (generally identified as "A") than the angle the skin bulge approaches the trailing blade between the two blades with a relatively larger tip-to-tip span (generally identified as "B"). The reduction in the angle that the skin approaches a razor blade effectively reduces the drag on the skin surface, which, in turn, results in increased safety (i.e., fewer nicks and cuts) and user comfort.

However, on the other hand, reducing the tip-to-tip span between blades has a negative impact on the rinsability of the razor cartridge. As the user shaves, hair clippings, skin particles, shaving cream, and/or other debris enter the space between the blades. In general, the smaller the tip-to-tip span, the more difficult it is to rinse the debris between the blades away. Debris that remains in the space between the blades can negatively affect the performance of the razor cartridge because the skin of the surface to be shaved is prevented from entering into the space between the two or more blades during normal shaving.

Therefore, the dilemma exists between the want to reduce the tip-to-tip span in order to increase comfort and the desire to widen the tip-to-tip span in order to achieve greater rinsibility. The difficulty in maximizing both factors is only increased by the fact that as the blades are moved closer together, the gap between the blades is eventually completely filled with razor blade and/or razor blade support material before the tips have achieved a tip-to-tip span that maximizes comfort. FIG. 2 illustrates the conundrum.

Therefore, there is a need in the art to provide a razor cartridge that effectively decreases the tip-to-tip span of the blades disposed in the razor cartridge in order to increase comfort, without limiting rinsability.

SUMMARY OF THE DISCLOSURE

According to the present invention, a razor cartridge includes a frame and a plurality of skin-engaging elements. The frame has a length, and the skin-engaging elements are disposed generally lengthwise on the frame. The skin-engaging elements include at least two or more blades and a first inter-blade guard. The blades are positioned in parallel relation to one another and have a sharpened cutting edge extending along at least a portion of a blade length. The first inter-blade guard has a skin-engaging surface and is disposed between two (2) blades such that one of the blades is immediately forward of the first inter-blade guard and one of the blades is positioned immediately aft the first inter-blade guard. A rinse-through gap extends between the first inter-blade guard and the blade immediately aft the first inter-blade guard across substantially the entire length of the blade immediately aft of the inter-blade guard. The rinse-through gap extends through the razor cartridge at an angle generally perpendicular to a shave plane.

According to one aspect of the present invention, the razor cartridge of the present invention may further include additional inter-blade guards similar to the first inter-blade guard described above, provided that each additional inter-blade guard is positioned between two blades, and each inter-blade guard is separated from each of the other inter-blade guards by at least one blade.

One advantage of the present invention is that during shaving, the effective span between skin-engaging elements is reduced, thereby increasing comfort and safety. In addition, the blade immediately aft of an inter-blade guard may be moved within a close proximity of the inter-blade guard without preventing rinse-through. Therefore, the comfort, safety, and rinsability of the present invention are improved over the prior art.

These and other advantages of the present invention will be apparent to one of ordinary skill in the art in light of the Detailed Description and Drawings.

BRIEF DESCRIPTION OF THE DRAWINGS

FIG. 2 is a side sectional view of a Prior Art razor cartridge depicting the minimum tip-to-tip span and the effect on rinse-through;

DETAILED DESCRIPTION

Figure 1:
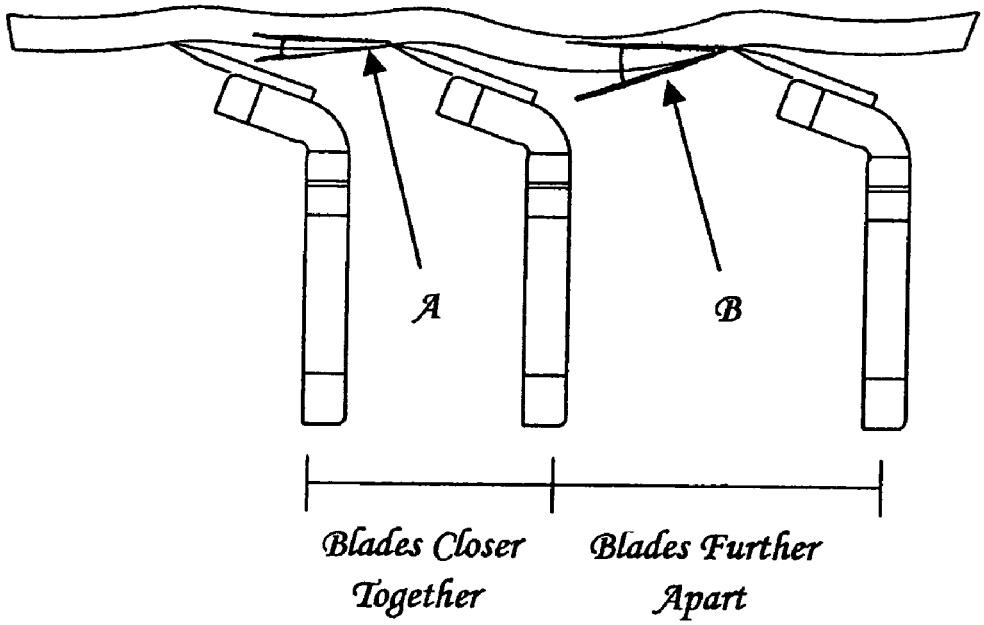
Fig. 1 Prior Art
FIG. 1 is a side sectional view of a Prior Art razor cartridge depicting the size of the skin bulge that enters the gap between blades with varying tip-to-tip spans.
Figure 2:
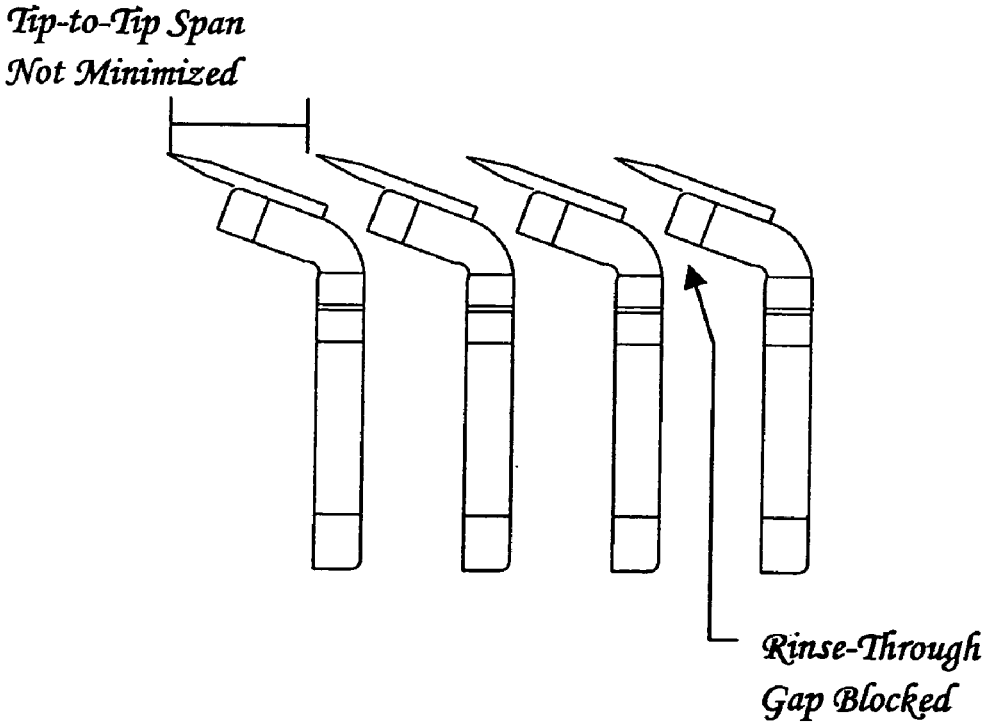
Fig. 2 Prior Art
Figure 3:
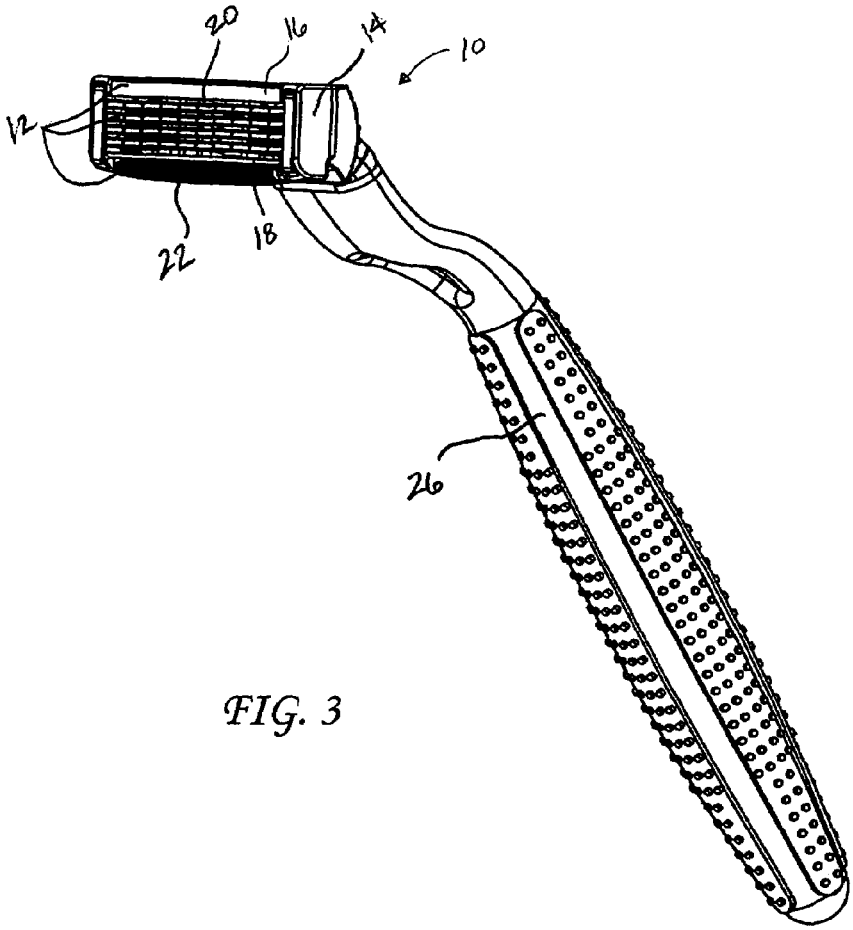
FIG. 3 is a perspective view of the razor cartridge of the present invention mounted on a handle.
Figure 4:
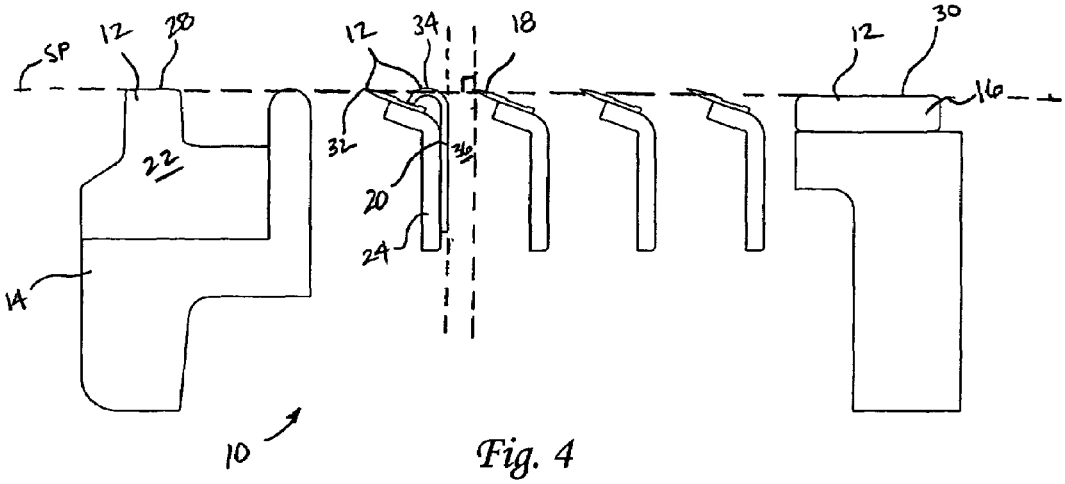
FIG. 4 is a side sectional view of FIG. 3A along line 4-4 where the razor cartridge includes an inter-blade guard between the first and second blades.
Figure 4A:
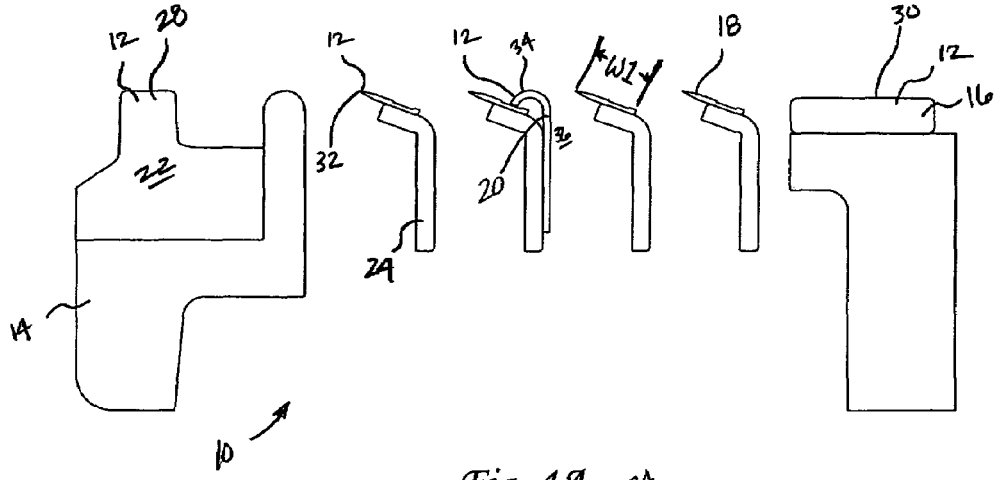
FIG. 4A is a side sectional view of FIG. 3A along line 4A-4A where the razor cartridge includes an inter-blade guard between the second and third blades.
Figure 4B:
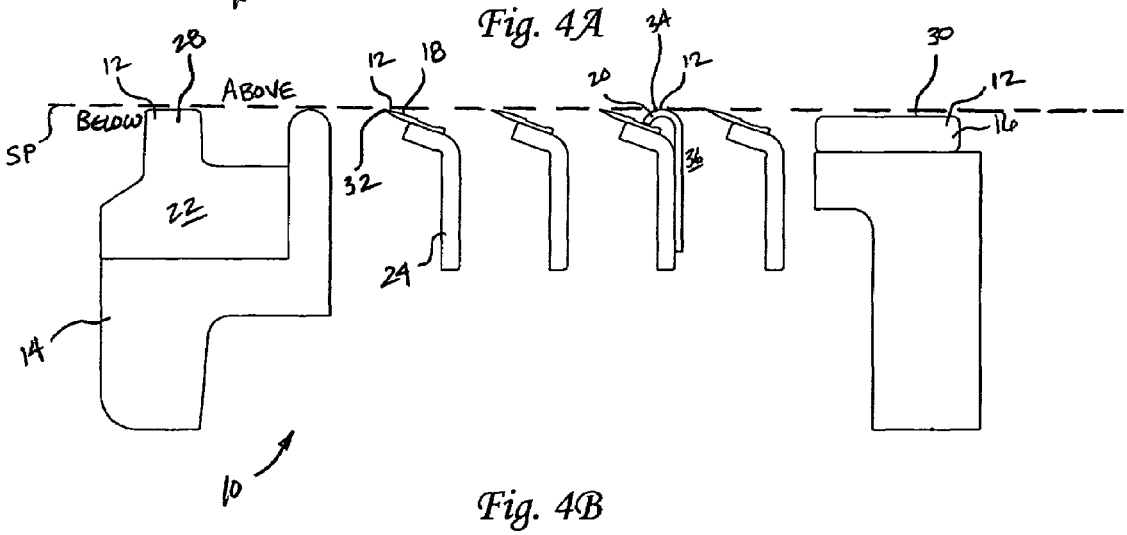
FIG. 4B is a side sectional view of FIG. 3A along line 4B-4B where the razor cartridge includes an inter-blade guard between the third and fourth blades.

Referring to FIGS. 3-4B, the razor cartridge of the present invention is generally identified by the numeral 10. The razor cartridge 10 defines a width ("W") and a length ("L") and includes plurality of skin-engaging elements 12 disposed on a frame 14. The skin-engaging elements 12 include a cap 16, at least two blades 18, a first inter-blade guard 20, and a guard 22. In some embodiments, the blades 18 and/or the first inter-blade guard 20 are mounted on a blade support structure 24, as shown, for example, in FIG. 4. In addition, the razor cartridge 10 is often attached, either permanently or removably, to a handle 26, as shown in FIG. 3.

Figure 3A:
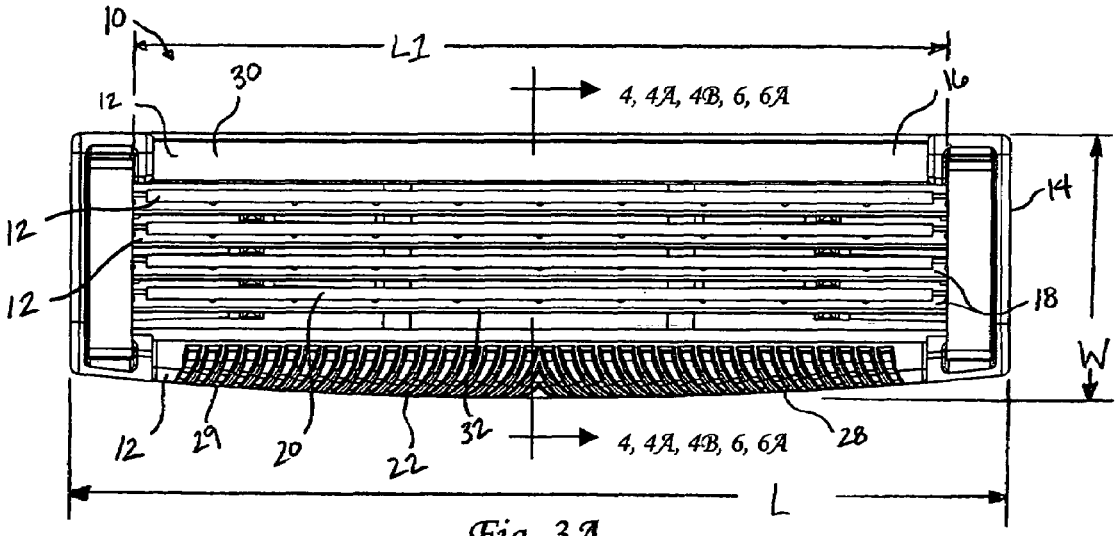
FIG. 3A is a front view of the razor cartridge of the present invention.

Referring to FIG. 3A, the guard 22 is disposed generally lengthwise on the frame 14 forward of the blades 18 and includes an outer skin-engaging surface 28. The guard 22 may be made of any suitable material known to those of skill in the art and may include additional elements, such as protrusions 29 and/or a shaving aid strip (not shown). The outer skin-engaging surface 28 of the guard 22 is in contact with the surface being shaved during normal shaving operation. The guard 22 is typically integrally formed with the frame 14; however, although not shown, the guard 22 may also be, for example, connected to the handle 26 and pivotally connected to the frame 14. Guards 22 are well known in the art and will therefore not be discussed in detail further herein other than to point out that the present invention is not limited to being used with any particular type of guard 22.

Continuing to refer to FIG. 3A, the cap 16 extends generally lengthwise across the frame 14 aft of the blades 18 and includes a skin-engaging surface 30. The skin-engaging surface 30 of the cap 16 is in contact with the surface being shaved during normal shaving operation. The cap 16 may be made of any suitable material known to those of skill in the art and, in some embodiments the cap 16 may include additional elements, such as the shaving aids. In general, caps 16 are well known in the art and will therefore not be discussed in detail further herein other than to point out that the present invention is not limited to being used with any particular type of cap 16.

The term "shave plane" as used herein is intended to represent the theoretical position of the surface being shaved during normal shaving operation, and is defined herein by a line extending widthwise across the razor cartridge 10 that is tangential to the skin-engaging surfaces 28, 30 of both the guard 22 and the cap 16. The shave plane (generally indicated by the dashed line in the Drawings and identified as "SP") is shown, for example, in FIG. 4A. In addition, the terms "above the shave plane" and "below the shave plane" are used herein to describe positions relative to the shave plane. Positions "above" and "below" the shave plane are identified in FIGS. 4 and 4B.

Referring now to FIGS. 3A and 4A, two or more blades 18, each having a length ("L1" as shown in FIG. 3A) and a width ("W1" as shown in FIG. 4A), are disposed on the frame 14 in parallel relation to one another between the guard 22 and the cap 16. Therefore, the razor cartridge 10 of the present invention may have two (2), three (3), four (4), or more blades 18 without departing from the scope of the present invention. Each of the blades 18 has a sharpened cutting edge 32 that extends along at least a portion of the width (W1) of the blade and are, preferably, substantially planar. Each blade 18 is disposed on the frame 14 such that the sharpened cutting edge 32 of each blade is located substantially near the shave plane (SP). In other words, the sharpened cutting edge 32 of each blade 18 may be substantially contiguous with, slightly above, or slightly below the shave plane (SP). Furthermore, each blade 18 may be mounted on the frame 12 such that the sharpened cutting edge 32 is movable relative to the shave plane (SP) under forces encountered during normal shaving. For example, in some embodiments, the sharpened cutting edge 32 may be located above the shave plane (SP) when the razor cartridge 10 is at rest, but may deflect to a position below the shave plane (SP) under the forces on the blade 18 during normal shaving. The location of each blade 18 relative to the shave plane (SP) during manufacture is independent to the location of each of the other blade(s) 18.

In some embodiments, such as those shown in FIGS. 4-4B, one or more of the blades 18 may be mounted on a blade support structure 24. Blade support structures 24 are known in the art to provide support for otherwise flexible blades 18 and are typically made of a bent piece of metal. Methods for mounting a blade 18 to a blade support 24 are known in the art, and, therefore, will not be discussed in greater detail herein.

Referring to FIGS. 4-4B, a first inter-blade guard 20 having a skin-engaging surface 34 is disposed between two (2) neighboring blades 18 such that one blade 18 is immediately forward of the first inter-blade guard 20 and one blade 18 is immediately aft of the first inter-blade guard 20, as shown, for example, in FIG. 4. Although FIG. 4 shows the first inter-blade guard 20 located between the first and second blades 18 aft of the guard 22, the first inter-blade guard 20 could also be located, for example, between any two blades 18, such as the second and third blades 18 (FIG. 4A) aft of the guard 22, or the third and fourth blades 18 (FIG. 4B) aft of the guard 22, without departing from the scope of the present invention.

The first inter-blade guard 20 is disposed on the frame 14 such that the skin-engaging surface 34 is located substantially near the shave plane (SP) such that the first inter-blade guard 20 is in contact with the surface being shaved during normal shaving operation. In other words, the razor cartridge may be assembled such that the first inter-blade guard 20 is substantially contiguous with, above, or below the shave plane (SP). Furthermore, the first inter-blade guard 20 may be mounted such that the skin-engaging surface 34 is movable relative to the shave plane (SP) under forces encountered during normal shaving. For example, in some embodiments, the skin-engaging surface 34 of the first inter-blade guard 20 may be located above the shave plane (SP) when the razor cartridge 10 is at rest, but may deflect to a position below the shave plane (SP) under the forces encountered during normal shaving.

Figure 5:
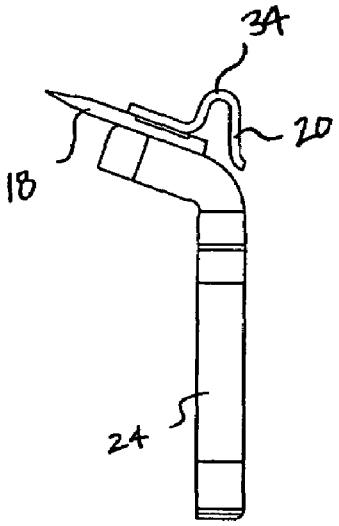
FIG. 5 is a side view of an example of suitable inter-blade guard shape.
Figure 5A:
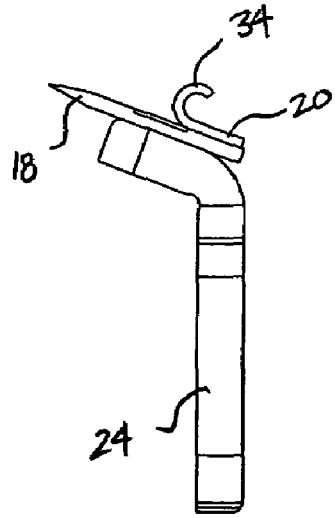
FIG. 5A is a side view of another example of suitable inter-blade guard shape.
Figure 5B:
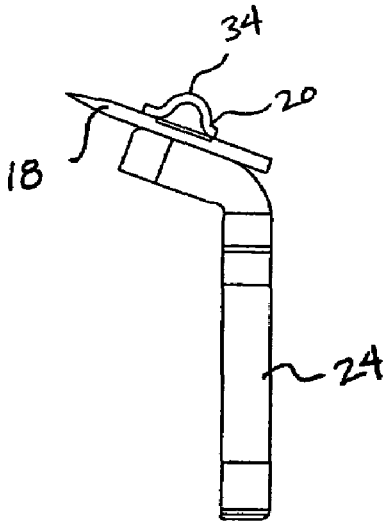
FIG. 5B is a side view of a further example of suitable inter-blade guard shape.

The first inter-blade guard 20 may have any suitable cross-sectional shape. In most embodiments, however, the first inter-blade guard 20 has a cross-sectional shape such that the skin-engaging surface 34 is curved, as shown in FIGS. 4, 4A and 4B. In addition, FIGS. 5-5D indicate several additional examples of suitable inter-blade guard geometries. However, the sample cross-sectional shapes shown are only exemplary in nature and are not to be considered inclusive of all possible first inter-blade guard 20 geometries.

Figure 5C:
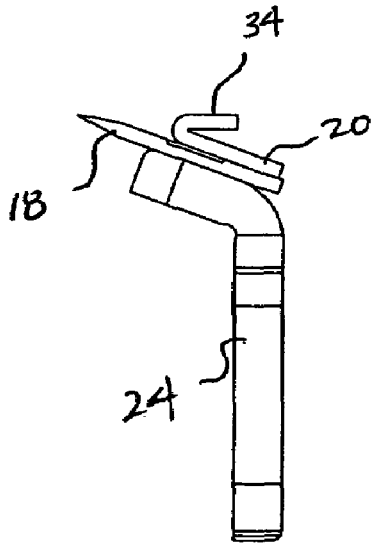
FIG. 5C is a side view of an even further example of suitable inter-blade guard shape.

Referring again to FIGS. 4-5C, the first inter-blade guard 20 may be mounted in the razor cartridge 10 in any suitable fashion, provided that a rinse-through gap 36 (generally indicated by dashed lines in FIG. 4) extends through the razor cartridge 10 and between the first inter-blade guard 20 and the blade 18 immediately aft of the inter-blade guard 20. For example, the first inter-blade guard 20 may be mounted to the blade support structure 24 (FIG. 4), to the blade 18 immediately forward of the inter-blade guard 20 (FIG. 5) and/or to the frame 14 (not shown).

The rinse through gap 36 preferably extends along substantially the entire length (L1) of the blade immediately aft of the first inter-blade guard. It is also preferable that the rinse-through gap 36 extends between the first inter-blade guard 20 and the blade 18 immediately aft of the first inter-blade guard at an angle substantially perpendicular to the shave plane (SP), as shown in FIG. 4.

In some embodiments, such as those shown in FIGS. 4-4B, the first inter-blade guard 20 is substantially adjacent to the blade 18 and/or blade support structure 24 immediately forward of the first inter-blade guard 20. In fact, in some embodiments, flow of shaving aid and other debris between the first inter-blade guard 20 and the blade 18 forward the first inter-blade guard 20 is substantially prevented during normal shaving.

Figure 6:
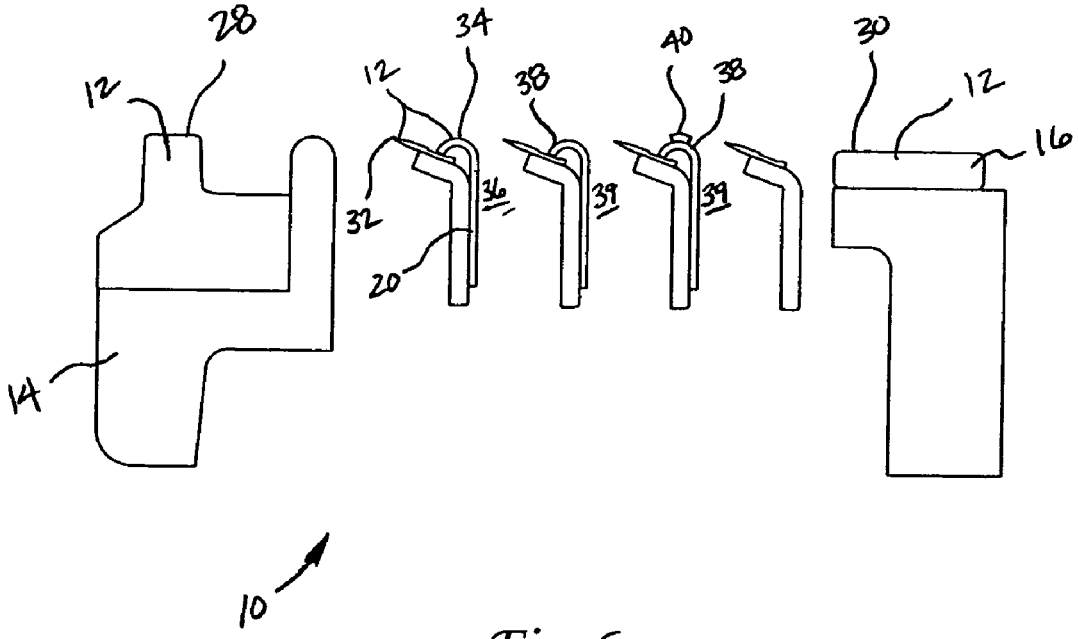
FIG. 6 is a side sectional view of FIG. 3A along line 6-6 where the razor cartridge of the present invention includes multiple inter-blade guards.

Referring now to FIG. 6, and according to one aspect of the present invention, the razor cartridge 10 of the present invention may include additional inter-blade guards 38 (e.g., a second inter-blade guard, a third inter-blade guard, and so on). Each of the additional inter-blade guard(s) 38 is mounted and shaped in a similar manner as described above with respect to the first inter-blade guard 20. Additional rinse-through gaps 39 extend between the additional inter-blade guard(s) 38 and the blade 18 immediately aft the same additional inter-blade guard(s) 38. The additional rinse-through gaps 39 extend along substantially the entire length (L1) of the blade immediately aft of the additional inter-blade guard 38. It is also preferable that the additional rinse-through gap (s) 39 extend through the razor cartridge at an angle substantially perpendicular to the shave plane (SP), as shown in FIG. 6.

In embodiments having additional inter-blade guards 38, such as is shown in FIG. 6, each inter-blade guard 20,38 is separated from the other inter-blade guards 20,38 by at least one blade 18. Although the inter-blade guards 20,38 of FIG. 6 are shown to be substantially identical, the geometry of the inter-blade guards 20,38 may vary within the same razor cartridge 10. In addition, each additional inter-blade guard 38 may be positioned substantially contiguous with, above, or below the shave plane (SP). Furthermore, the actual positioning of each inter-blade guard 20,38 relative to the shave plane (SP) may be independent of the positioning of each of the blades 18 and/or the other inter-blade guards 20,38.

The inter-blade guards 20,38 may be made of any suitable material. For example, metal and polymeric materials have proven to have particular utility. In addition, the inter-blade guards 20,38 may include additional elements, such as shaving aids. For example, a shaving aid strip 40 may be disposed on a portion of the skin-contacting surface 34 of one or more of the inter-blade guards 20,38, as shown in FIG. 6.

Figure 6A:
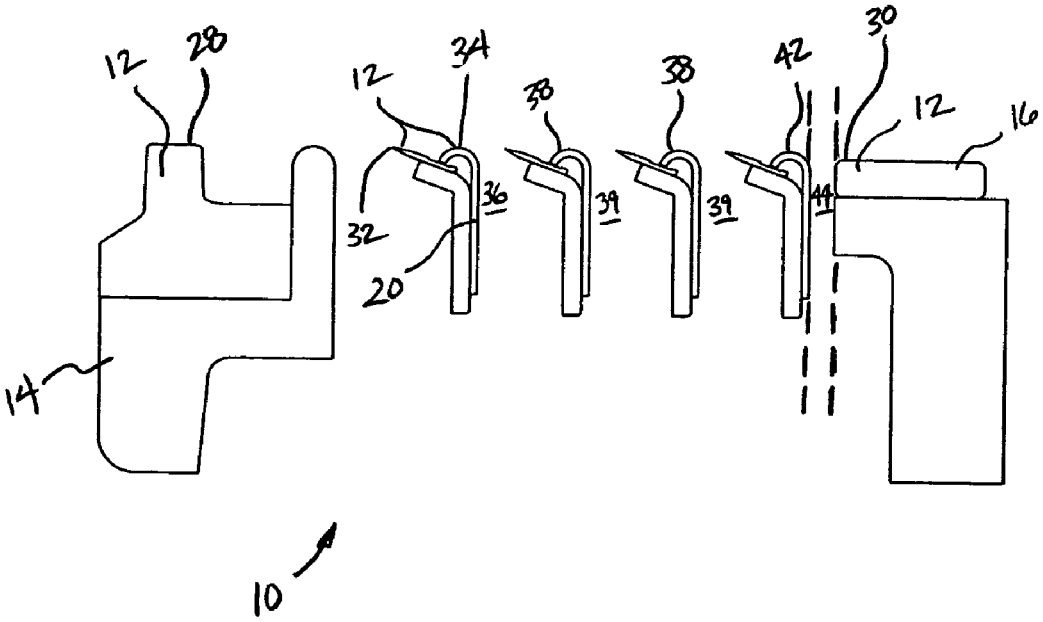
FIG. 6A is a side sectional view of FIG. 3A along line 6A-6A where the razor cartridge of the present invention includes multiple inter-blade guards and an additional blade guard between the cap and the blade immediately forward of the cap.

According to a further aspect of the present invention, a blade guard 42 having similar attributes to those of the first inter-blade guard 20 described above may be disposed in the razor cartridge 10 of the present invention between the cap 16 and the blade 18 immediately forward of the cap 16, as shown, for example, in FIG. 6A. A cap rinse-through gap 44 extends between the blade guard 42 and the cap 16 along at least a portion of the length (L) of the frame. It is also preferable that the cap rinse-through gap 44 extends through the razor cartridge 10 substantially perpendicular to the shave plane (SP), as shown in FIG. 6A.

The operation of the present invention will now be discussed in light of all of the figures. In operation, the skin engaging elements 12 (e.g., the guard 22, blades 18, the inter-blade guards 20,38, the blade guard 42, and/or the cap 16) of the razor cartridge 10 of the present invention are brought into contact with the surface to be shaved. As the user moves the razor cartridge 10 across the surface, the sharpened cutting edges of the blades shave the hair. The proximity of the inter-blade guards 20,38 and the blade 18 immediately aft of the same prevent too large of a skin bulge from entering the space provided between the two skin-engaging elements. Between shaving strokes, the user may choose to rinse any debris away from within the razor cartridge. The rinse-through gap 36,39 provided between the inter-blade guard(s) 20,38 and the blade 18 positioned immediately aft of the same allow for water to rinse away any debris that has collected. Likewise, the cap rinse-through gap 44, when present, allows for water to rinse away any debris.

Those skilled in the art will readily appreciate that there are various modifications and adaptations of the precise form of the invention here shown which may suit particular requirements.

What is claimed is:

1. A razor cartridge, comprising:

a frame defining a length;

a plurality of skin-engaging elements disposed generally lengthwise on the frame, the skin-engaging elements comprising:

two or more blades in parallel relation to one another, each of the blades having a sharpened cutting edge extending along at least a portion of a blade length and each of the two or more blades being affixed to a bent metal blade support; and a first inter-blade guard having a length and a skin-engaging surface disposed on the frame between two (2) blades such that one of the blades is immediately forward of the first inter-blade guard and one of the blades is positioned immediately aft the first inter-blade guard;

wherein the blade immediately forward of the first inter-blade guard completely separates the blade guard from the bent metal support such that the first inter-blade guard is spaced away from the bent metal support on which the blade immediately forward of the first inter-blade guard is affixed;

wherein a rinse-through gap extends between the first inter-blade guard and the blade immediately aft the first inter-blade guard continuously across substantially the entire length of the blade immediately aft of the first inter-blade guard, the rinse-through gap extending through the razor cartridge at an angle generally perpendicular to shave plane; and wherein the rinse through gap completely separates the blade support to which the blade immediately forward of the first inter-blade guard from the blade immediately aft the first inter-blade guard.

2. The razor cartridge of claim 1 wherein the razor cartridge includes at least three (3) blades.

3. The razor cartridge of claim 2 wherein the razor cartridge includes at least one additional inter-blade guard, each additional inter-blade guard being disposed between two (2) blades such that one blade is positioned immediately in front of each additional inter-blade guard and one blade is positioned immediately aft of each additional inter-blade guard, and wherein each inter-blade guard is separated from each of the other inter-blade guards by at least one blade.

4. The razor cartridge of claim 3 wherein an additional rinse-through gap extends between each of the additional inter-blade guards and the blade immediately aft the same additional inter-blade guard and substantially across the length of the blade immediately aft of the additional inter-blade guard.

5. The razor cartridge of claim 1 further comprising a cap, the cap being disposed on the frame aft of two or more blades.

6. The razor cartridge of claim 5 further comprising a blade guard disposed between the cap and the blade immediately forward of the cap, and wherein a cap rinse-through gap extends between the blade guard and the cap across at least a portion of the length of the frame.

7. The razor cartridge of claim 6 wherein the cap rinse-through gap extends through the razor cartridge at an angle generally perpendicular to the shave plane.

8. A razor cartridge, comprising:

a frame defining a length;

a plurality of skin-engaging elements disposed generally lengthwise on the frame, the skin-engaging elements comprising:

two or more substantially planar blades disposed on the frame in parallel relation to one another, each of the blades having a sharpened cutting edge extending along at least a portion of a blade length, and each of the blades being supported by individual bent blade supports; and a first inter blade guard having a curved skin-engaging surface disposed on the blade immediately forward thereof such that the entirety of the first inter blade guard is located between the sharpened cutting edge of the blade immediately forward thereof and the blade immediately aft thereof such that one of the blades is the skin-engaging element immediately forward of the first inter-blade guard and the other blade is the skin-engaging element immediately aft the first inter-blade guard;

wherein the first inter-blade guard is adjacent at least a portion of the blade immediately forward of the first inter-blade guard and the blade immediately forward of the first inter-blade guard completely separates the first inter-blade guard from the bent blade support on which the blade immediately forward of the first inter-blade guard is supported such that the first inter-blade guard and the blade immediately forward of the first inter-blade guard are spaced apart; and wherein a rinse-through gap extends through the razor cartridge between the first inter-blade guard and the blade immediately aft the first inter-blade guard, the rinse-through gap extending continuously all the way across a length of the blade aft of the first inter-blade guard.

9. The razor cartridge of claim 8 wherein the razor cartridge includes at least three (3) blades.

10. The razor cartridge of claim 9 wherein the razor cartridge includes at least one additional inter-blade guard, each additional inter-blade guard being disposed between two (2) blades such that one blade is positioned immediately in front of each additional inter-blade guard, and wherein each inter-blade guard being separated from each of the other inter-blade guards by at least one blade.

11. The razor cartridge of claim 10 wherein an additional rinse-through gap extends between each of the additional inter-blade guard and the blade immediately aft the same additional inter-blade guard and substantially across the length of the blade immediately aft of the same additional inter-blade guard.

12. The razor cartridge of claim 8 further comprising a cap, the cap being disposed on the frame aft of the two or more blades.

13. The razor cartridge of claim 12 further comprising a blade guard disposed between the cap and the blade immediately forward of the cap, and wherein a cap rinse-through gap extends between the blade guard and the cap across at least a portion of the length of the frame.

14. The razor cartridge of the claims 13 wherein the cap rinse-through gap extends through the razor cartridge at an angle generally perpendicular to the shave plane.

15. A razor cartridge, comprising:

a housing having a forward edge, a rear edge and an opening between the forward and rear edges; and at least two blade units, each blade unit comprising:

a metal blade support structure having a first portion and a second portion, the first and second portions being separated by a bend;

a generally planar razor blade having a sharpened cutting edge, the razor blade being mounted to the first portion of the razor blade support;

a blade guard having a skin-engaging surface, the blade guard being affixed to the razor blade such that the skin-engaging surface is generally adjacent to the cutting edge of the razor blade;

wherein the blade of each blade unit completely separates the blade guard from the metal blade support structure such that the blade guard and the metal blade support structure are spaced apart;

wherein the at least one blade unit positioned within the housing opening between the forward edge and the rear edge; and wherein the two blade units are separated by a rinse thru gap that extends continuously along the entire length of the blade immediately aft of the first inter blade guard, the rinse thru gap extending aft of the entire first blade unit and forward of the entire second blade unit.

16. The razor cartridge of claim 15, wherein the razor cartridge includes at least three blade units.

17. The razor cartridge of claim 15, wherein the razor cartridge includes at least four blade units.

* * * * *